US009941636B2

(12) United States Patent
Jodon De Villeroche et al.

(10) Patent No.: US 9,941,636 B2
(45) Date of Patent: Apr. 10, 2018

(54) PYROTECHNIC CONNECTOR

(71) Applicant: Tyco Electronics France SAS, Pontoise (FR)

(72) Inventors: Francois Jodon De Villeroche, La Celle St Cloud (FR); Xavier Rouillard, Franconville (FR); Olivier Pamart, Ecouen (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 15/484,629

(22) Filed: Apr. 11, 2017

(65) Prior Publication Data

US 2017/0294742 A1 Oct. 12, 2017

(30) Foreign Application Priority Data

Apr. 11, 2016 (FR) ..... 16 53178

(51) Int. Cl.
*H01R 13/639* (2006.01)
*H01R 13/52* (2006.01)
(Continued)

(52) U.S. Cl.
CPC ..... *H01R 13/639* (2013.01); *H01R 13/5202* (2013.01); *H01R 13/5219* (2013.01);
(Continued)

(58) Field of Classification Search
CPC ..... H01R 13/639; H01R 13/5202; H01R 13/5219; H01R 13/6271
(Continued)

(56) References Cited

U.S. PATENT DOCUMENTS 5,853,298 A * 12/1998 Pacher ..... H01L 29/1608 439/352
6,811,424 B2 * 11/2004 Seminara ..... H01R 13/639 439/188
(Continued)

FOREIGN PATENT DOCUMENTS

EP 2876745 A1 5/2015
FR 3008833 A1 7/2013
(Continued)

OTHER PUBLICATIONS

French Search Report, dated Dec. 26, 2016, 10 pages.
(Continued)

*Primary Examiner* — Tho D Ta
*Assistant Examiner* — Travis Chambers
(74) *Attorney, Agent, or Firm* — Barley Snyder

(57) ABSTRACT

A pyrotechnic electrical connector comprises a housing and a connector position assurance device. The housing is configured for plugging in and locking to a mating connector. The housing receives a plurality of electrical terminals to be connected to a plurality of mating electrical terminals of the mating connector. The connector position assurance device is insertable in the housing in an insertion direction to a delivery position and a locking position. The locking position maintains locking of the housing to the mating connector when the housing is plugged in and locked to the mating connector. Insertion of the connector position assurance device is blocked at the delivery position and prevented from reaching the locking position if the housing is not plugged in or locked to the mating connector.

15 Claims, 10 Drawing Sheets

(51) Int. Cl.
*H01R 13/641* (2006.01)
*H01R 13/627* (2006.01)

(52) U.S. Cl.
CPC ..... *H01R 13/6273* (2013.01); *H01R 13/641* (2013.01); *H01R 13/6271* (2013.01)

(58) Field of Classification Search
USPC ..... 439/352
See application file for complete search history.

(56) References Cited

U.S. PATENT DOCUMENTS 6,893,277 B2 * 5/2005 Parrish ..... H01R 13/506 439/188
7,077,428 B2 * 7/2006 Barker ..... B60R 21/2644 102/202
7,131,854 B1 * 11/2006 Pavlovic ..... H01R 13/6273 439/352
7,247,039 B2 * 7/2007 Annecke ..... H01R 13/7032 439/188
7,766,685 B2 * 8/2010 Pabst ..... H01R 13/533 439/352
7,997,940 B2 * 8/2011 Regnier ..... H01R 13/5219 439/272
8,602,809 B2 * 12/2013 Kyoyama ..... H01R 13/516 439/358
8,968,021 B1 * 3/2015 Kennedy ..... H01R 13/6273 439/352
9,325,114 B2 * 4/2016 Miklinski ..... H01R 13/6273
9,614,323 B2 * 4/2017 Chen ..... H01R 13/6273
2004/0166715 A1 * 8/2004 Parrish ..... H01R 13/506 439/352
2004/0192098 A1 * 9/2004 Pavlovic ..... H01R 13/627 439/350
2005/0009390 A1 * 1/2005 Barker ..... H01R 13/631 439/188
2015/0037996 A1 * 2/2015 Chen ..... H01R 13/6273 439/345
2015/0162705 A1 * 6/2015 Tan ..... H01R 13/6272 439/357
2015/0219708 A1 * 8/2015 Odorfer ..... H01R 13/641 324/538
2015/0311633 A1 * 10/2015 Miklinski ..... H01R 13/6273 439/345
2017/0012392 A1 * 1/2017 Kot ..... H01R 13/03

FOREIGN PATENT DOCUMENTS

FR 3010841 A1 9/2013
WO 2012007343 A1 1/2012
WO WO 2012030335 A1 * 3/2012 ..... H01R 13/6273
WO 2014194997 A1 12/2014

OTHER PUBLICATIONS

Abstract of EP2876745, dated May 27, 2015, 1 page.
Abstract of FR3010841, dated Mar. 20, 2015, 1 page.
Abstract of FR3008833, dated Jul. 22, 2013, 1 page.

* cited by examiner

PYROTECHNIC CONNECTOR

CROSS-REFERENCE TO RELATED APPLICATION

This application claims the benefit of the filing date under 35 U.S.C. § 119(a)-(d) of French Patent Application No. 1653178, filed on Apr. 11, 2016.

FIELD OF THE INVENTION

The present invention relates to an electrical connector and, more particularly, to an electrical connector for a safety restraint system having a pyrotechnic device.

BACKGROUND

Known safety restraint systems, such as safety belts or airbags of motor vehicles, have pyrotechnic devices which trigger the tightening of a belt or the inflation of an airbag in accordance with impact or vibration information which is received by sensors of the vehicle. Electrical cables connect a control unit of the sensor to the corresponding pyrotechnic device and lead to an electrical connector. The pyrotechnic electrical connector is connected to a mating connector of an ignition support. These pyrotechnic connectors incorporate secondary locking systems or connector position assurance devices ("CPA devices"), which maintain a reliable connection with the mating connector of the ignition support in an environment regularly subjected to impacts or vibrations, such as in a motor vehicle.

Automotive manufacturers provide precise and standardized specifications for connectors used in a given series or given make of vehicle. Certain specifications require compact connectors, however, compactness requirements impair the reliable connection and locking of known pyrotechnic connectors.

SUMMARY

An object of the invention, among others, is to provide a pyrotechnic connector which is compact while also capable of being reliably connected to an ignition support. The pyrotechnic electrical connector according to the invention comprises a housing and a connector position assurance device. The housing is configured for plugging in and locking to a mating connector. The housing receives a plurality of electrical terminals to be connected to a plurality of mating electrical terminals of the mating connector. The connector position assurance device is insertable in the housing in an insertion direction to a delivery position and a locking position. The locking position maintains locking of the housing to the mating connector when the housing is plugged in and locked to the mating connector. Insertion of the connector position assurance device is blocked at the delivery position and prevented from reaching the locking position if the housing is not plugged in or locked to the mating connector.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
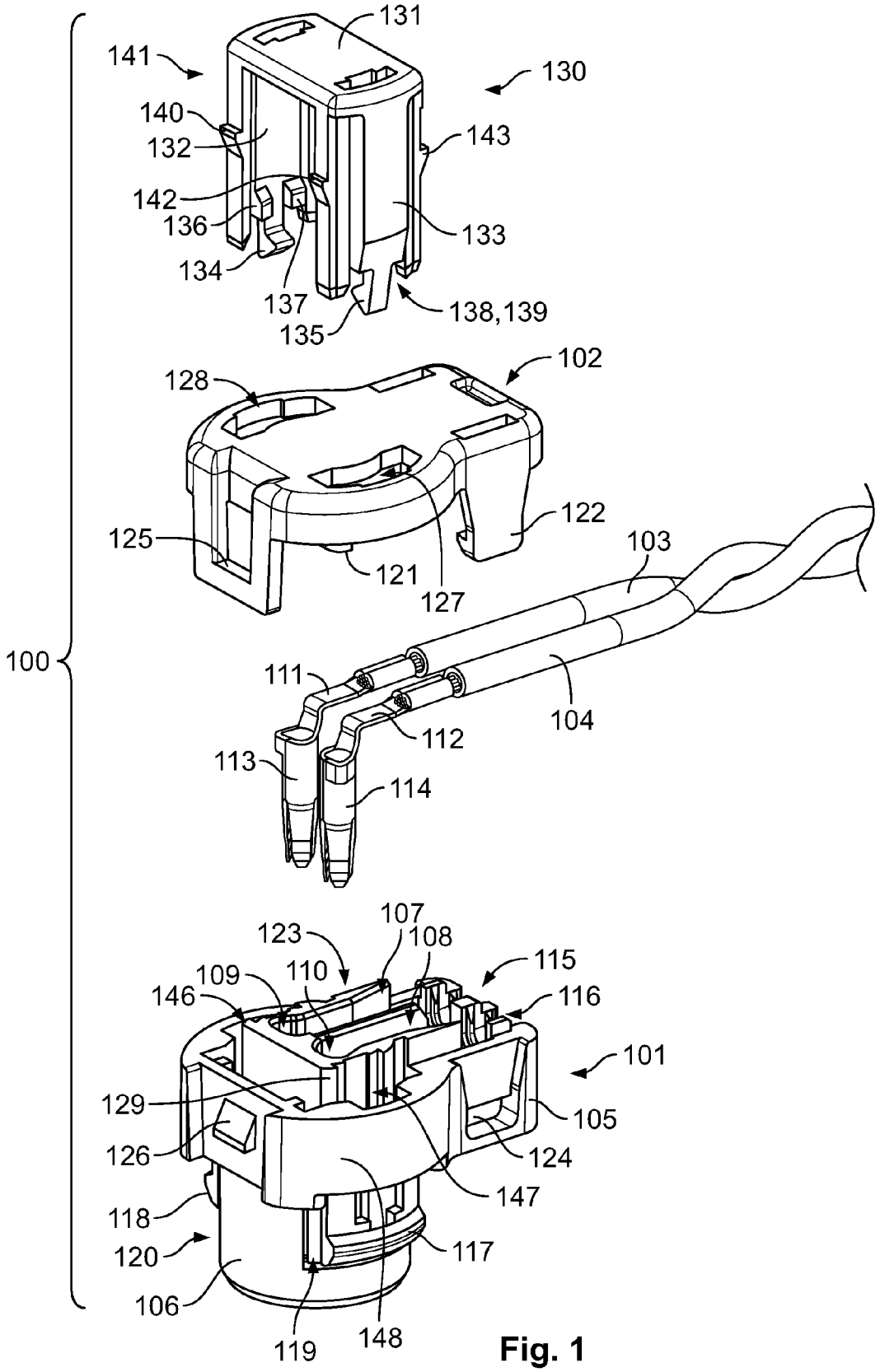
FIG. 1 is an exploded view of a pyrotechnic connector according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2A:
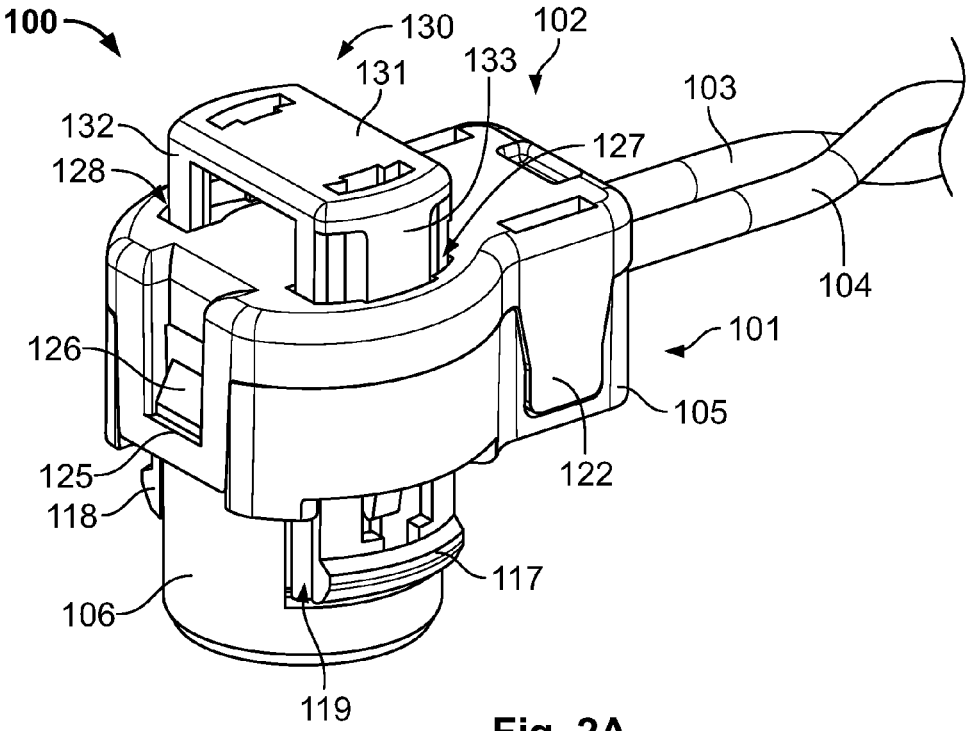
FIG. 2A is a perspective view of the connector of FIG. 1 in a delivery position.
Figure 2B:
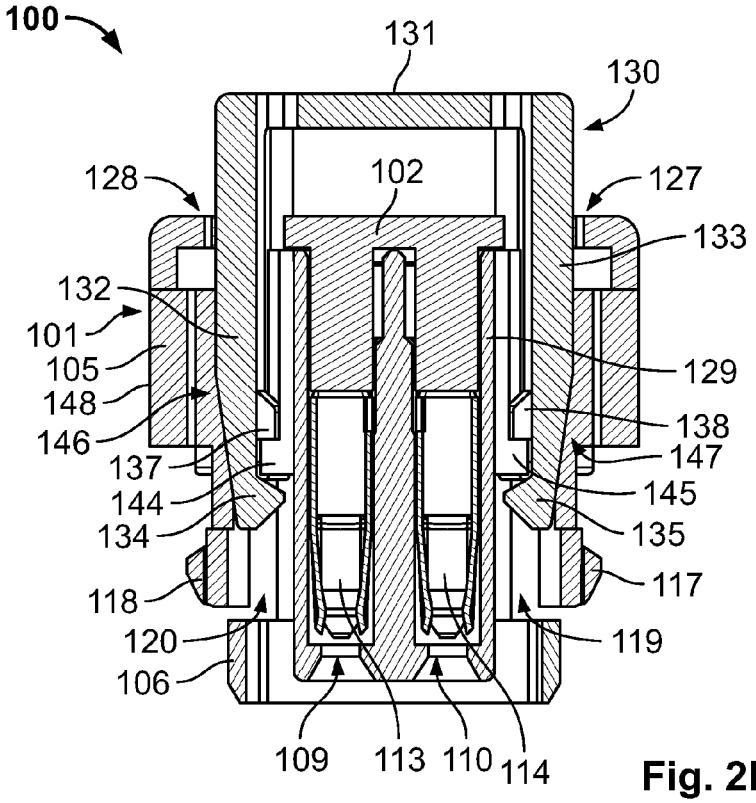
FIG. 2B is a sectional view of the connector of FIG. 1 in the delivery position.

A pyrotechnic electrical connector 100 according to the invention is shown in FIGS. 1, 2A, and 2B. The connector 100 comprises a housing 101, a cover 102, and a connector position assurance device 130 ("CPA device").

The housing 101, as shown in FIGS. 1, 2A, and 2B, comprises a main portion 105 of substantially parallelepipedal geometry having passage openings 115, 116 and receptacles 107, 108 for receiving and accommodating two cables 103, 104. The main housing 101 also has a connection portion 106 which is substantially perpendicular to the main portion 105 and integral therewith. The connection portion 106 is substantially cylindrical and is of suitable geometry for being plugged in a standard ignition support, as described in greater detail below. The receptacles 107, 108 have ends extending as contact openings 109, 110 into the connection portion 106 and which receive contact posts 113, 114 of terminals 111, 112 which are crimped at an exposed end of each of the cables 103, 104. The connection portion 106 has two housing locking arms 117, 118 which can be deflected towards the inside of the connection portion 106 in a respective deflection space 119, 120.

The cover 102, as shown in FIGS. 1, 2A, and 2B, is removably attachable to the housing 101. The cover 102 is substantially planar to produce a compact pyrotechnic electrical connector 100. The cover 102 has two cover locking arms 121, 122, which allow locking with housing locking receptacles 123, 124 of the housing 101. The cover 102 has a cover locking receptacle 125 which can be locked by a housing locking protrusion 126 of the housing 101. As shown in FIG. 2B, when the cover 102 is fixed to the housing 101, the cover 102 ensures that the contact posts 113, 114 are held in the contact openings 109, 110 of the connection portion 106.

The CPA device 130, as shown in FIGS. 1, 2A, and 2B, is an element separate from the cover 102. The CPA device 130 is inserted into openings 127, 128 of the cover 102. The CPA device 130 has an upper surface 131 on which a user can press in order to insert the CPA device 130 in the housing 101 of the connector 100 through the openings 127, 128 of the cover 102 when it is fixed to the housing 101, as shown in FIGS. 2A and 2B. The CPA device 130 has two CPA locking arms 132, 133 extending from opposite ends of the surface 131 and each terminating in a latch 134, 135. The openings 127, 128 of the cover 102 are sized and configured for insertion of the CPA locking arms 132, 133. While passing through the openings 127, 128, the CPA locking arms 132, 133 are received in spaces 146, 147 of the connection portion 106, substantially between an outer portion 148 and an internal portion 129 of the connection portion 106.

Each CPA locking arm 132, 133, as shown in FIGS. 1 and 2B, has one or more first protrusions 136, 137 or 138, 139, which are arranged and configured in such a manner that the CPA device 130 can only be inserted in the housing 101, more specifically in the connection portion 106, as far as a delivery position shown in FIGS. 2A and 2B. In order to prevent the CPA device 130 from reaching a locking position thereof before the connector 100 is plugged and correctly locked in an ignition support, insertion of the CPA locking arms 132, 133 in the connection portion 106 is blocked by a plurality of ribs 144, 145 of the housing 101. The ribs 144, 145, as shown in FIG. 2B, project radially outwards on an internal portion 129 of the connection portion 106. The first protrusions 136, 137 abut a first rib 144 at a first side and the other first protrusions 138, 139 abut a second rib 145 at a second side. The CPA device 130 thus cannot be inserted into the connection portion 106 past the delivery position shown in FIGS. 2A and 2B when the connector 100 is not connected to a mating connector.

The CPA device 130 is also prevented from being removed from the connection portion 106 when the CPA device 130 is in the delivery position shown in FIGS. 2A and 2B. The CPA device 130 has one or more second protrusions 140, 141, 142, 143 disposed laterally on the CPA locking arms 132, 133, as shown in FIG. 1. The second protrusions 140, 141, 142, 143 can be redirected resiliently in order to allow the insertion of the CPA locking arms 132, 133 through the openings 127, 128 and move into abutment against the cover 102 during a withdrawal attempt of the CPA device 130 from the assembled connector 100.

The pyrotechnic electrical connector 100 is inserted into and locked with a mating connector, which is an ignition support 200 shown in FIGS. 3A-3D. The connector 100 allows connection of the cables 103, 104 from, for example, a control unit of an impact and/or vibration sensor for a safety restraint system, to a pyrotechnic charge which is connected to the ignition support 200.

The ignition support 200 may be a conventional ignition support used by an automotive manufacturer in the context of a safety restraint system such as an airbag or a safety belt of a motor vehicle. The ignition support, as shown in FIGS. 3A-3D, has a base portion 201 which is substantially cylindrical and which comprises, over an internal circumference, a locking groove 203 which is disposed below an edge 207 of the base portion 201. Contact pins 204, 205 project from the bottom of the base portion 201 and can be, for example, connected to a pyrotechnic charge. The contact pins 204, 205 are mating electrical terminals of the ignition support 200, which is the mating connector. The ignition support 200 also has a retention ring 202 disposed in the base portion 201.

As will be described below with reference to FIGS. 3A-3D, the insertion of the connection portion 106 of the connector 100 into the ignition support 200 is conducted in an insertion direction 300.

Figure 3B:
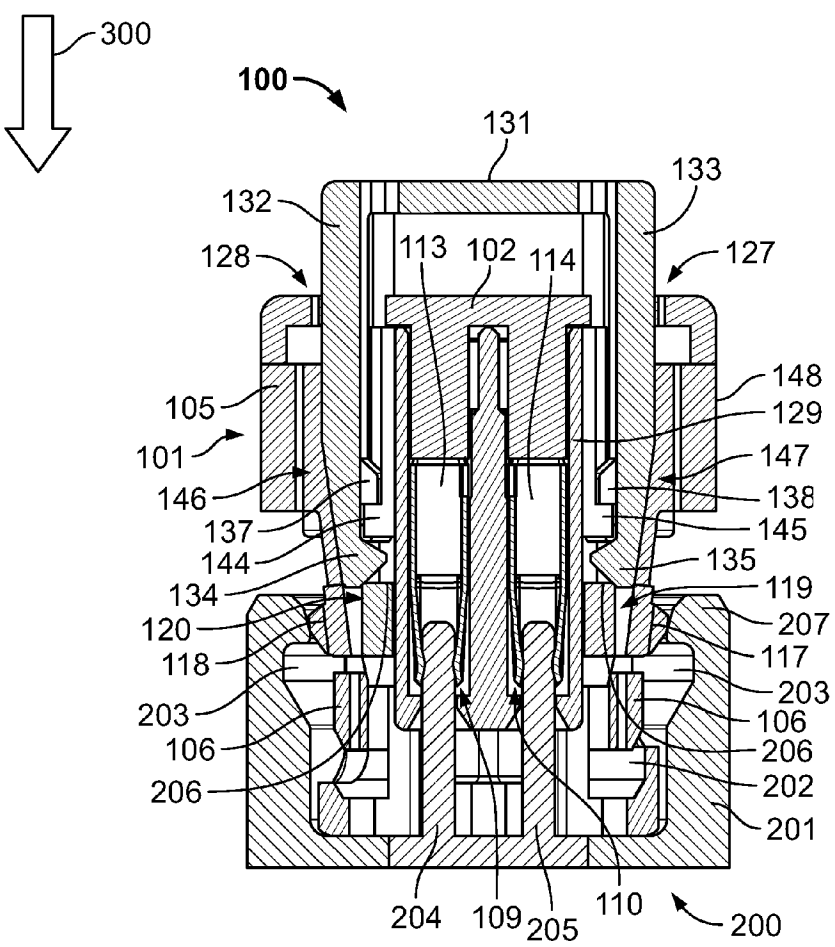
FIG. 3B is a sectional view of a second step of plugging the connector of FIG. 1 in the ignition support.
Figure 3A:
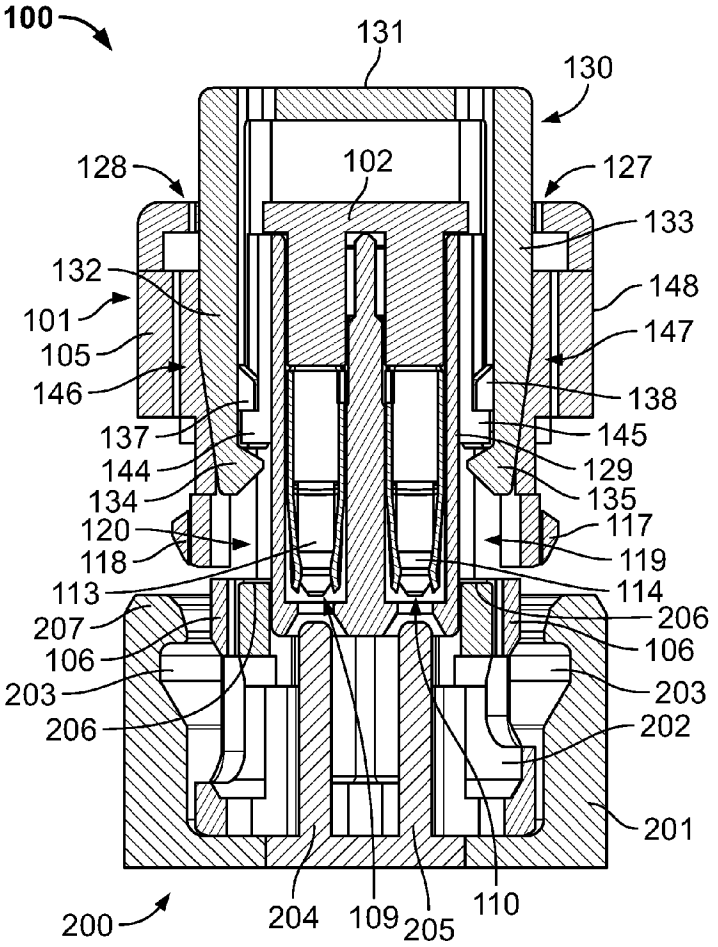
FIG. 3A is a sectional view of a first step of plugging the connector of FIG. 1 in an ignition support.

As shown in FIG. 3A, in order to insert the connector 100 in the ignition support 200 in the insertion direction 300, the connection portion 106 is presented facing the ignition support 200 in order to be plugged between the retention ring 202 and the base portion 201. The contact pins 204, 205 of the ignition support 200 face the openings 109, 110 in which the similar contact posts 113, 114 of the connector 100 are disposed. The connector 100 is presented with the CPA device 130 in the delivery position shown in FIGS. 2A and 2B. In the first step shown in FIG. 3A, the end of the connection portion 106 may have just slightly passed a support surface 206 of the retention ring 202 and there is no electrical contact between the contact posts 113, 114 and the contact pins 204, 205.

A second step of the insertion of the connector 100 into the ignition support 200 is shown in FIG. 3B. In this step, the housing locking arms 117, 118 are resiliently deflected towards the inside of the connection portion 106 into the spaces 119, 120 by interaction with the edge 207 of the ignition support 200. The contact pins 204, 205 advance into the openings 109, 110 and are partially inserted in the contact posts 113, 114, initiating electrical contact. The CPA device 130 is still blocked in the delivery position thereof described above and cannot advance towards a locking position. The latches 134, 135 of the CPA locking arms 132, 133 contact the contact section 206 of the retention ring 202 of the ignition support 200.

Figure 3D:
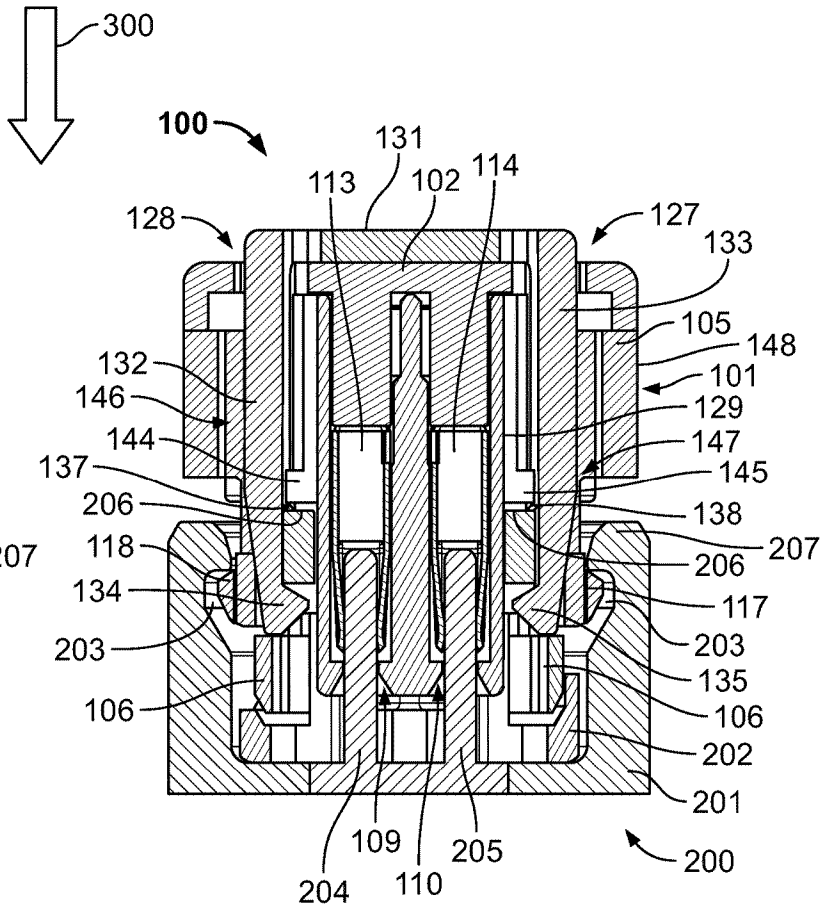
FIG. 3D is a sectional view of a fourth step of plugging the connector of FIG. 1 in the ignition support.
Figure 3C:
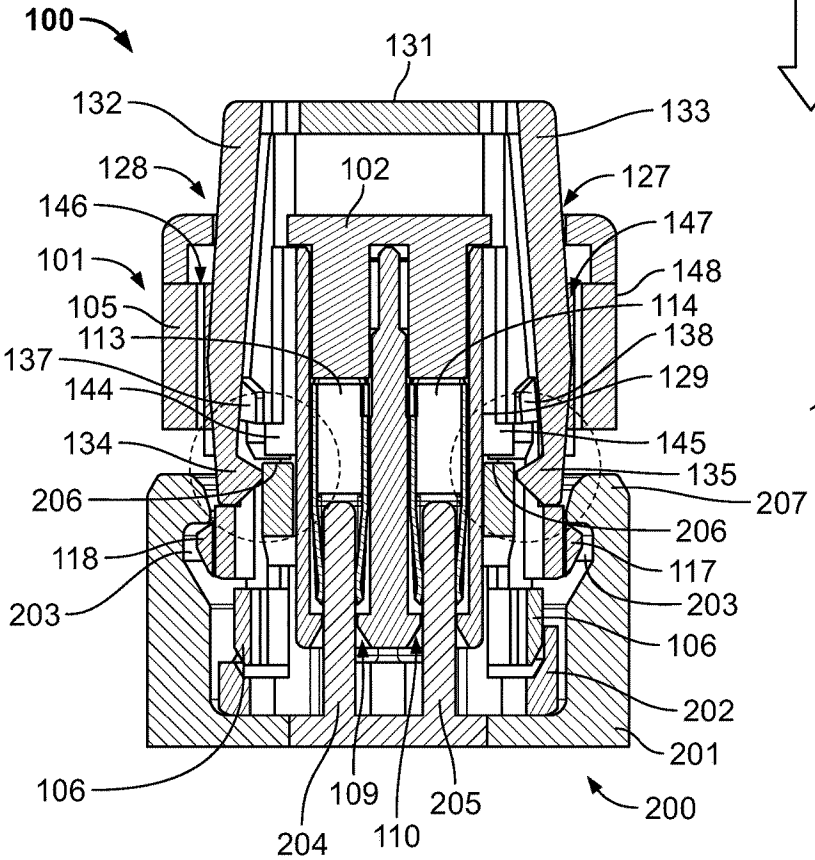
FIG. 3C is a sectional view of a third step of plugging the connector of FIG. 1 in the ignition support.

A third step of the insertion of the connector 100 into the ignition support 200 is shown in FIG. 3C. The contact pins 204, 205 are further advanced in the contact posts 113, 114. The resilient return of the housing locking arms 117, 118 to the delivery position thereof, having passed the edge 207 of the ignition support 200, now produces the main or primary locking of the connector 100 to the ignition support 200, as the housing locking arms 117, 118 are received in the locking groove 203. The release or disengagement function of the CPA device 130 will now be described. As shown by the two zones circled with broken lines in FIG. 3C, the latches 134, 135 of the CPA device 130 interact with the contact section 206, which resiliently deflects the CPA locking arms 132, 133 radially towards the outside of the connector 100 and into the spaces 146, 147. The protrusions 136, 137 and 138, 139 are disengaged from abutment against the ribs 144, 145 by deflecting of the CPA locking arms 132, 133. The CPA device 130 is thus released from the delivery position.

As shown in FIG. 3D, in a fourth step, the CPA device 130 released from the delivery position is inserted into the housing 101 to a locking position of the CPA device 130. A surface of the CPA device 130 abuts the cover 102. The protrusions 136, 137 and 138, 139 have passed the ribs 144, 145 and the CPA locking arms 132, 133 resiliently return to a rest position, forming a secondary locking of the connector 100 to the ignition support 200. The CPA locking arms 132, 133 are received behind the housing locking arms 117, 118, securing the housing locking arms 117, 118 in the locking groove 203 and thereby preventing the housing locking arms 117, 118 from opening and the connector 100 from disconnecting from the ignition support 200. The latches 134, 135 also hook to the retention ring 202 below the contact section 206.

The CPA locking arms 132, 133 secure the CPA device 130 in the delivery position and prevent the CPA device 130 from performing secondary locking before the connector 100 is correctly inserted in the ignition support 200. The CPA locking arms 132, 133, as described above, also release the CPA device 130 from the delivery position and perform the secondary locking when the connector 100 is correctly inserted in the ignition support 200.

Figure 4:
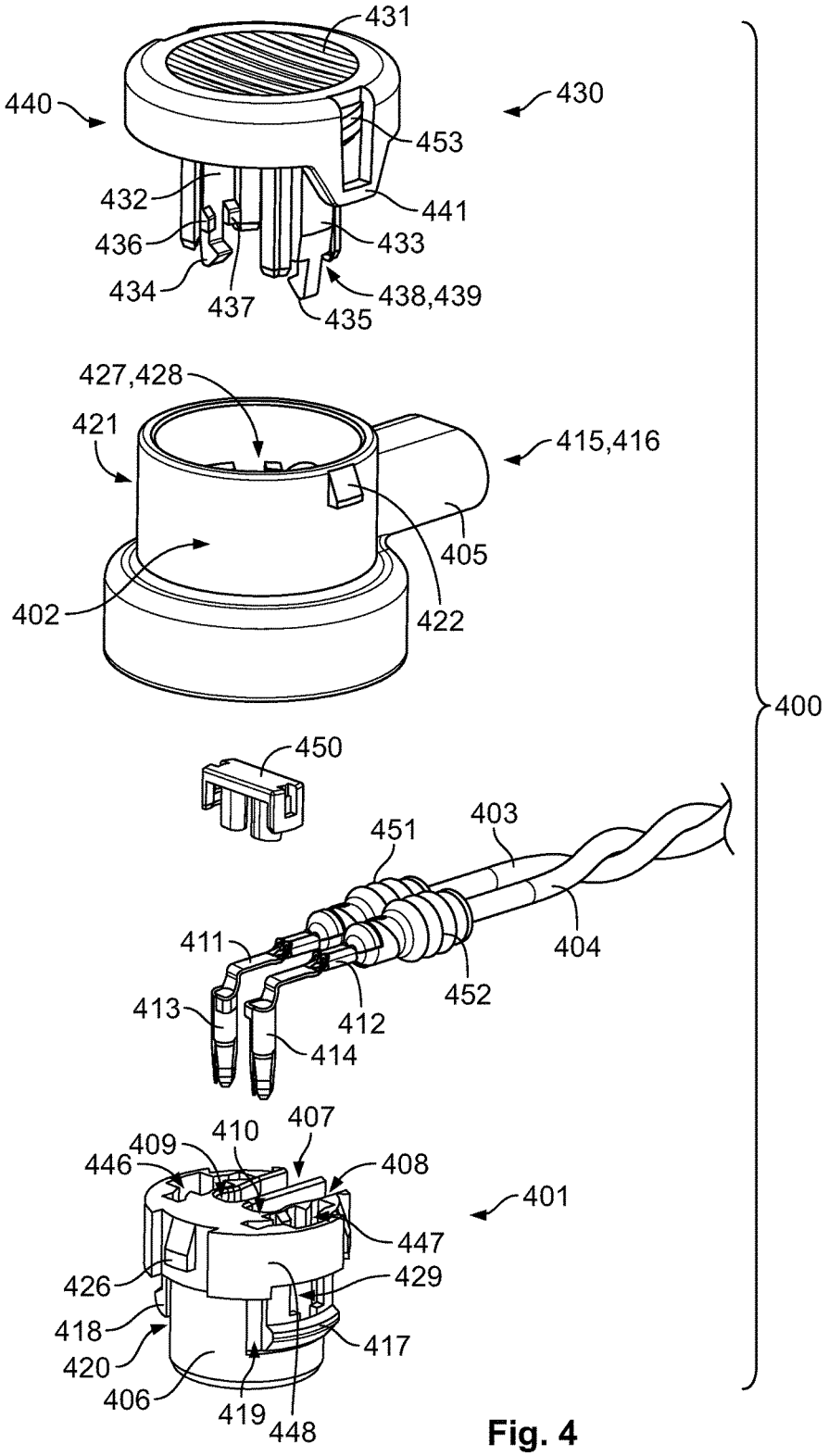
FIG. 4 is an exploded view of another pyrotechnic connector according to the invention.
Figure 5A:
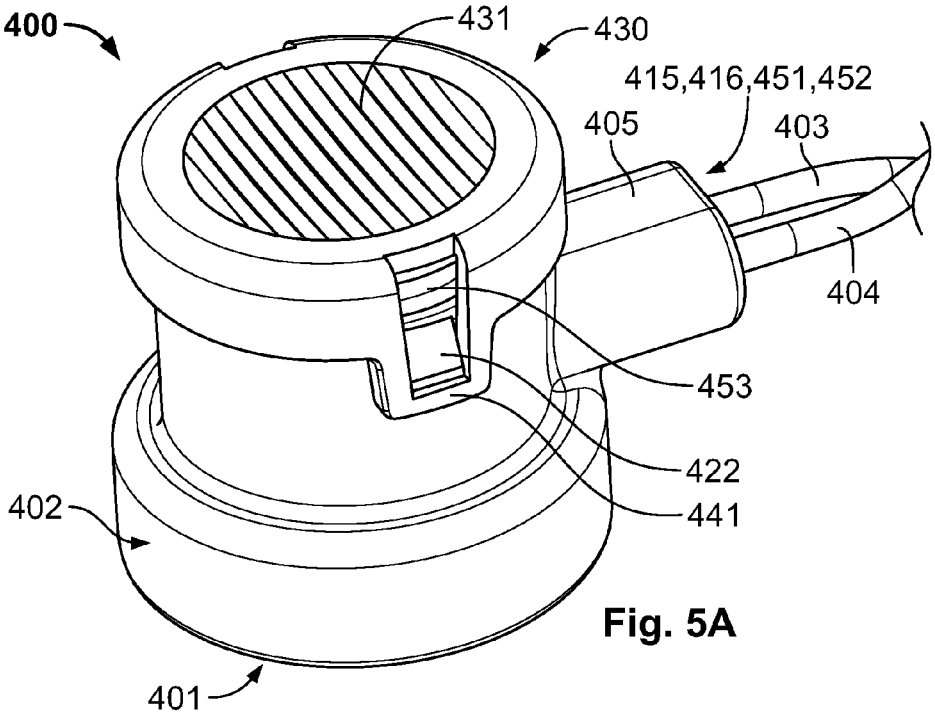
FIG. 5A is a perspective view of the connector of FIG. 4 in a delivery position.
Figure 5B:
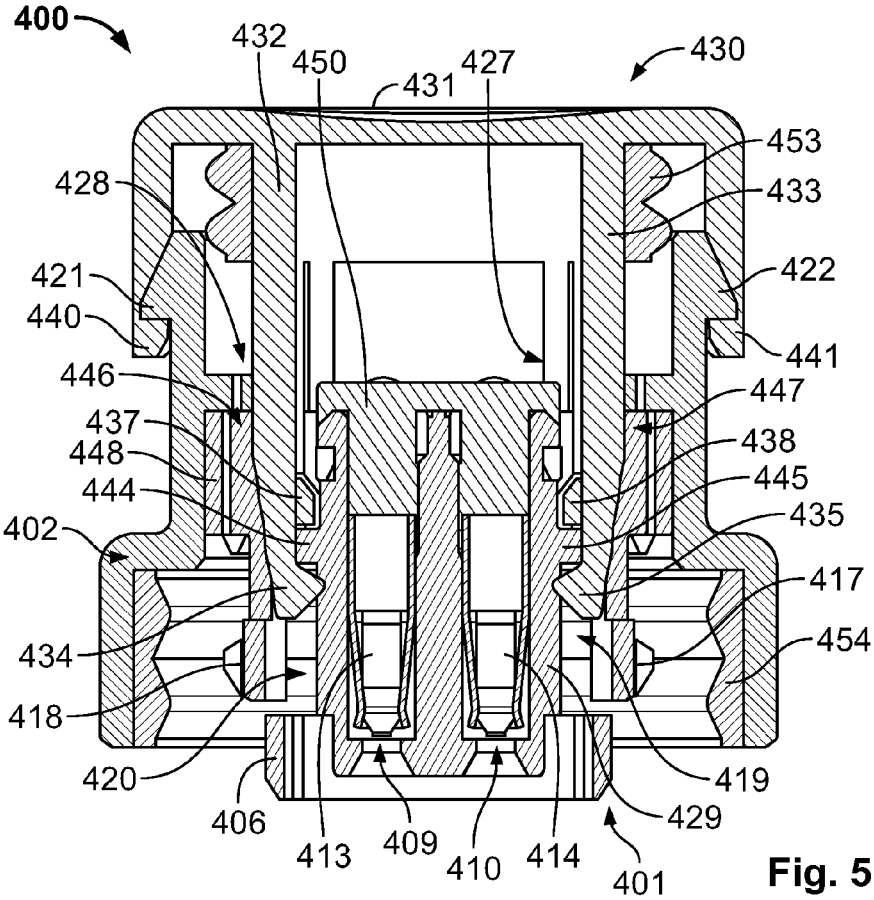
FIG. 5B is a sectional view of the connector of FIG. 4 in the delivery position.

A pyrotechnic electrical connector 400 according to another embodiment of the invention is shown in FIGS. 4, 5A, and 5B. The connector 400 is similar to the connector 100 described above, and in the below description, like reference numerals refer to like elements; the description of some elements of the connector 400 similar to those of the connector 100 are omitted in the below description for brevity.

The connector 400 allows connection of cables 403, 404 from, for example, a control unit of an impact and/or vibration sensor for a safety restraint system, to a pyrotechnic charge which is connected to the ignition support 200. The connector 400 comprises a housing 401, a cover 402, and a connector position assurance device 430 ("CPA device") which have similar functionalities to the housing 101, cover 102, and CPA device 130 of the connector 100 described above.

In order to make the connector 400 even more compact than the connector 100, the connector housing 401, as shown in FIGS. 4, 5A, and 5B, only has a connection portion 406, and the cables 403, 404 crimped with terminals 411, 412 comprising contact posts 413, 414 are inserted through openings 415, 416 of a receiving portion 405 provided directly on the cover 402. In order to ensure a desired level of fluid-tightness and/or insulation in relation to the external environment, the cables 403, 404 have cable annular sealing joints 451, 452 which are suitable for ensuring fluid-tightness in the region of the openings 415, 416 of the receiving portion 405 of the cover 402. Aside from the receiving portion 405, the cover 402 has a geometry which corresponds to the connection portion 406 and is substantially cylindrical.

The cover 402 has cover protrusions 421, 422, as shown in FIGS. 4, 5A, and 5B, which lock to CPA device locking receptacles 440, 441 of the CPA device 430 rather than with the housing 401. The cover 402 also has at least one internal locking element locking, once the cover 402 has been mounted on the housing 401, the housing locking protrusion 426 of the connection portion 406. A first annular sealing joint 454 is disposed on an internal circumference of the cover 402 so as to ensure desired fluid-tightness and/or insulation in relation to the external environment when the connector 400 is plugged in an ignition support. A second annular sealing joint 453 is disposed on an internal circumference of the CPA device 430 in order to ensure a desired level of fluid-tightness between the CPA device 430 and the cover 402.

The connection portion 406 of the main housing 401, as shown in FIGS. 4, 5A, and 5B, is similar to the connection portion 106 of the connector 100; when the cover 402 is mounted on the housing 401, the cables 403, 404 are received in the receptacles 407, 408 and the contact posts 413, 414 are received in the contact openings 409, 410 extending into the connection portion 406. The terminals 411, 412 and the contact posts 413, 414 thereof are fixed in position by a terminal position assurance device 450 ("TPA device") in a delivery position of the connector 400. The connecting portion 406 has two housing locking arms 417, 418 resiliently deflectable towards the inside of the connection portion 406 in the respective spaces 419, 420, allowing insertion in an ignition support and producing primary locking thereto in a manner similar to that described with reference to FIGS. 3C and 3D.

The CPA device 430, as shown in FIGS. 4, 5A, and 5B, has CPA locking arms 432, 433 which perform the same functions as the CPA locking arms 132, 133 of the CPA device 130 described in the embodiment of FIGS. 1-3. The CPA locking arms 432, 433 secure the CPA device 430 in the delivery position, disengage the CPA device 430 from the delivery position by abutment against the retention ring 202 of the ignition support 200, and perform secondary locking once the CPA device 430 is inserted to a locking position thereof to maintain locking of the housing locking arms 417, 418 to the ignition support 200. The CPA device 430 is an element separate from the cover 402. A cap 431 of the CPA device 430 covers the cover 402 and the CPA locking arms 432, 433 are inserted in the cover 402 through respective openings 427, 428, as shown in FIGS. 5A and 5B, so as to be received in spaces 446, 447 between the outer portion 448 and an internal portion 429 of the connection portion 406 of the housing 401. The CPA locking arms 432, 433 have one or more first protrusions 436, 437 or 438, 439 and each terminate in a latch 434, 435, similarly to the CPA locking arms 132, 133 of the embodiment of FIGS. 1-3.

As long as the connector 400 is not plugged and locked by the housing locking arms 417, 418 in the mating ignition support 200, the CPA device 430 can be inserted in the connection portion 406 of the housing 401 only as far as the delivery position shown in FIG. 5B. The internal portion 429 of the connection portion 406 of the housing 401 comprises one or more ribs 444, 445 projecting substantially radially outwards from the internal portion 429 and forming a stop for the first protrusions 436, 437 and 438, 439. In the delivery position, insertion is limited by the abutment of the protrusions 436, 437 and 438, 439 on the respective ribs 444, 445 of the internal portion 429 and withdrawal is limited by the abutment of the CPA device locking receptacles 440, 441 on the cover protrusions 421, 422 of the cover 402.

Once the connector 400 is assembled and in the delivery position, the insertion and locking of the connector 400 the ignition support 200 is the same as described in FIG. 3A-3D. With the connector 400, an added level of fluid-tightness and/or insulation is produced by sealing joints 451, 452, 453, 454.

Figure 6:
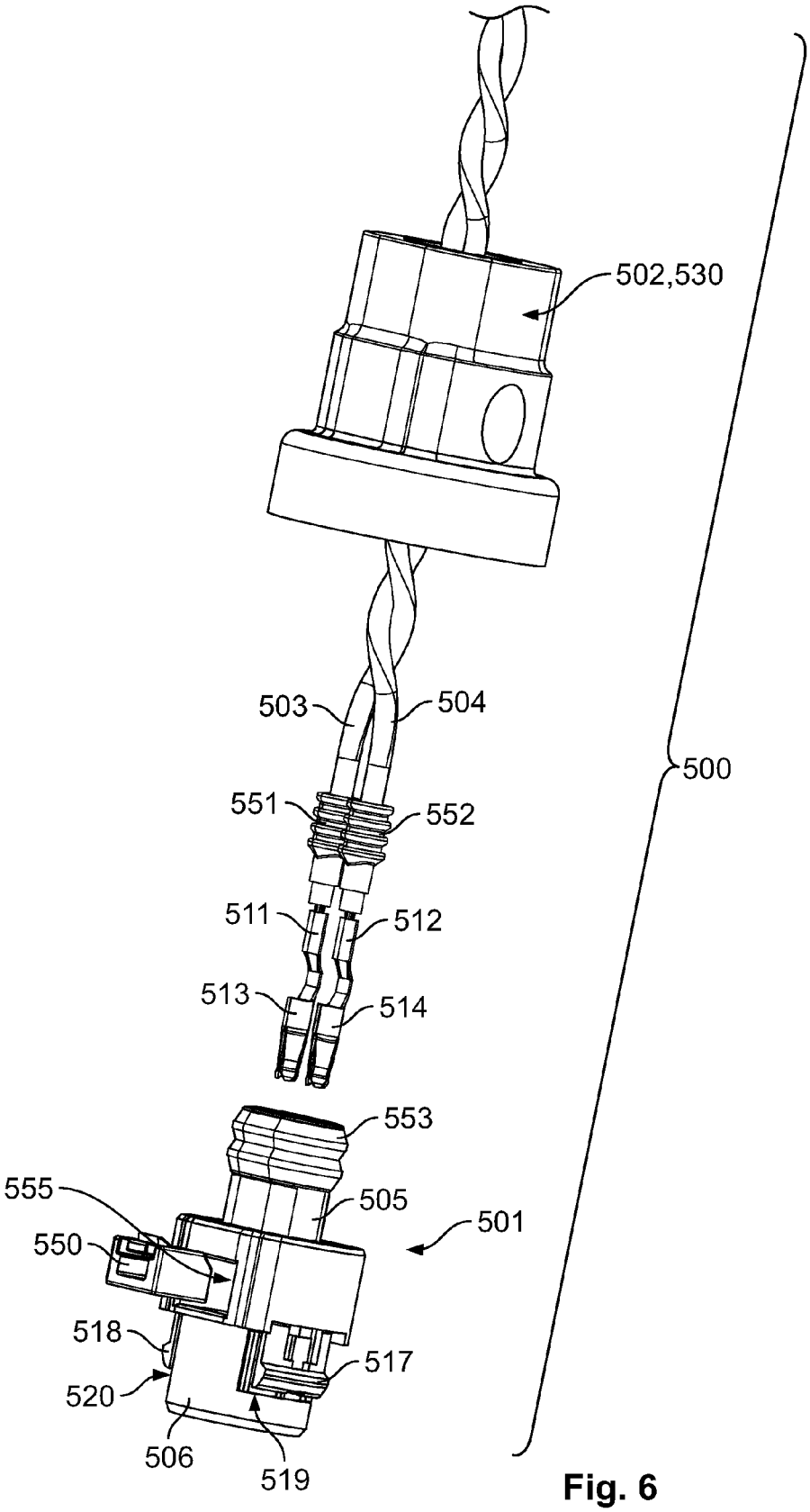
FIG. 6 is an exploded view of another pyrotechnic connector according to the invention.
Figure 7B:
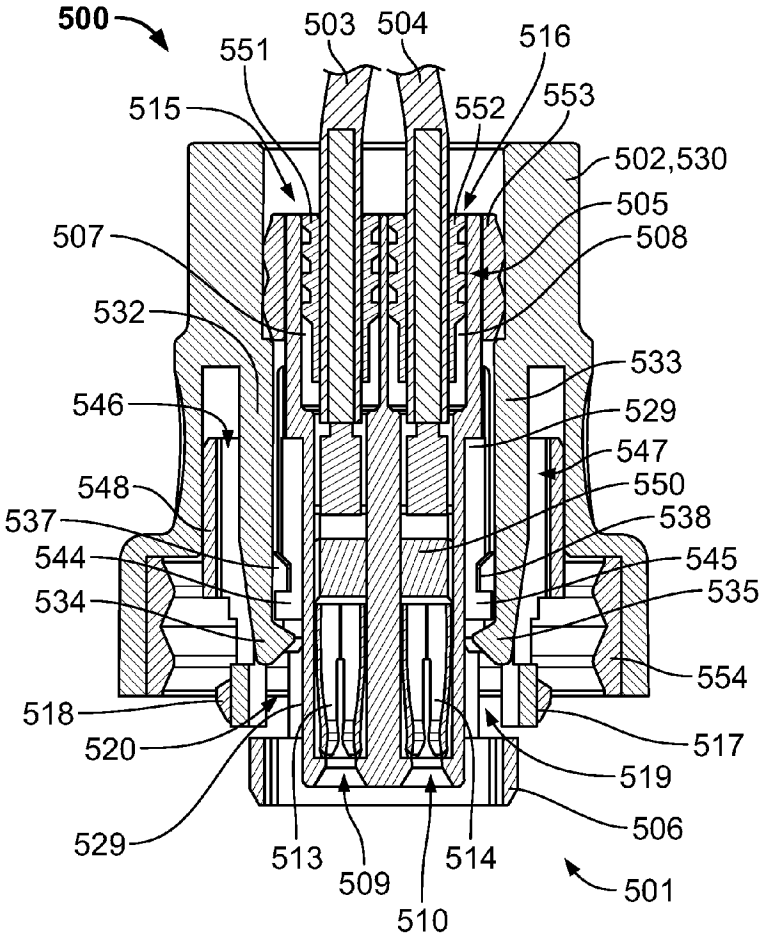
FIG. 7B is a sectional view of the connector of FIG. 6 in the delivery position.
Figure 7A:
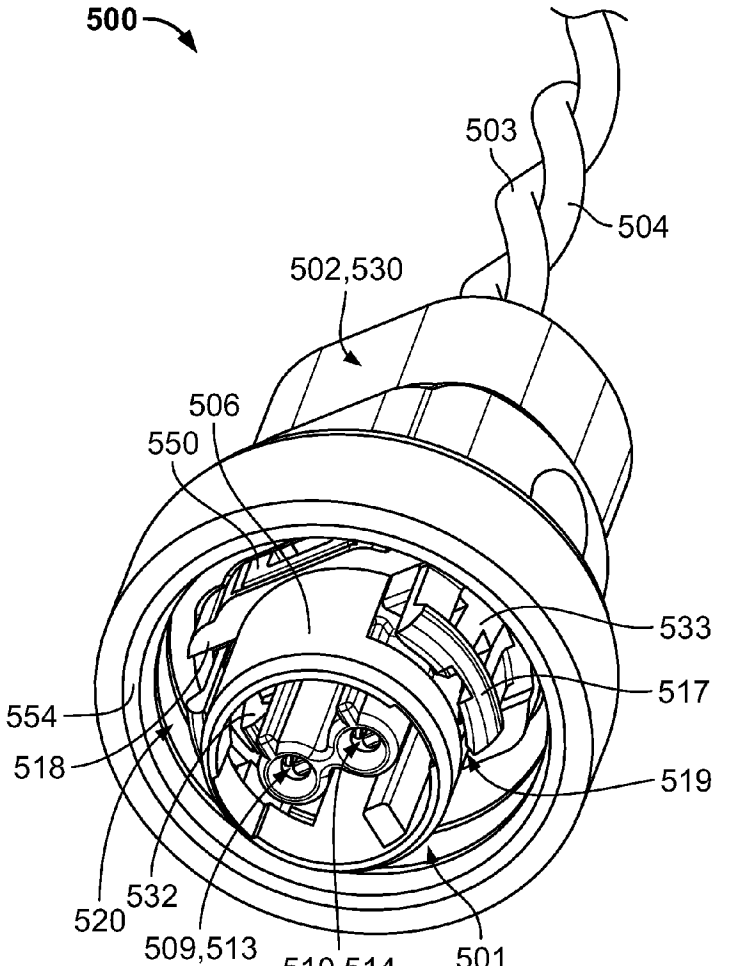
FIG. 7A is a perspective view of the connector of FIG. 6 in a delivery position.

A pyrotechnic electrical connector 500 according to another embodiment of the invention is shown in FIGS. 6, 7A, and 7B. The connector 500 is similar to the connectors 100, 400 described above, and in the below description, like reference numerals refer to like elements; the description of some elements of the connector 500 similar to those of the connectors 100, 400 are omitted in the below description for brevity. The connector 500 allows connection of cables 503, 504 from, for example, a control unit of an impact and/or vibration sensor for a safety restraint system, to a pyrotechnic charge which is connected to the ignition support 200.

The integration of the CPA device 530 with the cover 502 is a notable difference between the connector 500 and the connectors 100, 400 of the preceding embodiments. The CPA device 530, as shown in FIGS. 6, 7A, and 7B, is provided integrally with the cover 502, forming an even more compact connector 500 than the connectors 100, 400.

The housing 501 of the connector 500, as shown in FIGS. 6, 7A, and 7B, has a receiving portion 505 which is arranged as an extension of the connection portion 506 and therefore is arranged in the insertion direction of the connector 500. The cables 503, 504 which are crimped with terminals 511, 512 comprising contact posts 513, 514 are inserted through the openings 515, 516 of the receiving portion 505 in the insertion direction. Similarly to the connector 400, in order to ensure a desired level of fluid-tightness and/or insulation with respect to the external environment, in the connector 500 the cables 503, 504 have cable annular sealing joints 551, 552 suitable for ensuring fluid-tightness in the region of the openings 515, 516 of the receiving portion 505 of the housing 501 of the connector 500. Similarly, a first annular sealing joint 554 is disposed on an internal circumference of the portion forming the cover 502 of the assembly comprising the cover/CPA device 502, 530 so as to ensure a desired fluid-tightness and/or insulation with respect to the external environment when the connector 500 is plugged in the ignition support 200, and a second annular sealing joint 553 is disposed around the receiving portion 505 in the region of the openings 515, 516 in order to ensure a desired level of fluid-tightness between the housing 501 and the assembly comprising the cover/CPA device 502, 530.

The connection portion 506 of the housing 501, as shown in FIGS. 6, 7A, and 7B, has the same characteristics as the connection portions 106 and 406 of the connectors 100 and 400. The compact configuration of the connector 500 is such that, unlike the preceding embodiments, the contact posts 413, 414 can remain aligned with the body of the terminals 511, 512 in order to be received in the receptacles 507, 508 of the receiving portion 505. The contact posts 513, 514 are received in the contact openings 509, 510 in extension of the receptacles 507, 508 descending into the connection portion 506. The contact posts 513, 514 can also be fixed in position by a TPA device 550 inserted through a lateral opening 555 of the connection portion 506. The connection portion 506 has housing locking arms 517, 518 resiliently deflectable towards the inside of the connection portion 506 in the respective spaces 519, 520 in order to allow insertion in the ignition support 200.

The CPA device 530, as shown in FIGS. 7A and 7B, has CPA locking arms 532, 533 which, similarly to the CPA devices 130, 430, secure the CPA device 530 in the delivery position, disengage the CPA device 530 from the delivery position by abutment against the retention ring 202 of the ignition support 200, and perform secondary locking once the CPA device 530 is inserted to a locking position thereof to maintain locking of the housing locking arms 517, 518 to the ignition support 200. The CPA locking arms 532, 533 have one or more first protrusions 536, 537 and each terminate in a latch 534, 535. In the CPA device 530, unlike the preceding embodiments, the CPA locking arms 532, 533 are inserted directly in the spaces 546, 547 between the outer portion 548 and an internal portion 529 of the connection portion 506 of the housing 501, as shown in FIG. 7B.

As long as the connector 500 is not plugged and locked by the housing locking arms 517, 518 in the mating ignition support 200, the CPA device 530 and cover 502 assembly can be inserted in the housing 501 only as far as the delivery position shown in FIG. 7B. The internal portion 529 of the connection portion 506 of the housing 501 comprises one or more ribs 544, 545 projecting substantially radially outwards from the internal portion 529 and forming a stop for the first protrusions 537, 538. In the delivery position, insertion is limited by the abutment of the protrusions 537, 538 on the respective ribs 544, 545 of the internal portion 429.

The pyrotechnic electrical connector 500 is inserted into and locked with a mating connector, which is the ignition support 200 shown in FIGS. 8A-8D. The connector 500 allows connection of the cables 103, 104 from, for example, a control unit of an impact and/or vibration sensor for a safety restraint system, to a pyrotechnic charge which is connected to the ignition support 200. As will be described below with reference to FIGS. 8A-8D, the insertion of the connector 500 into the ignition support 200 is conducted in an insertion direction 300.

Figure 8B:
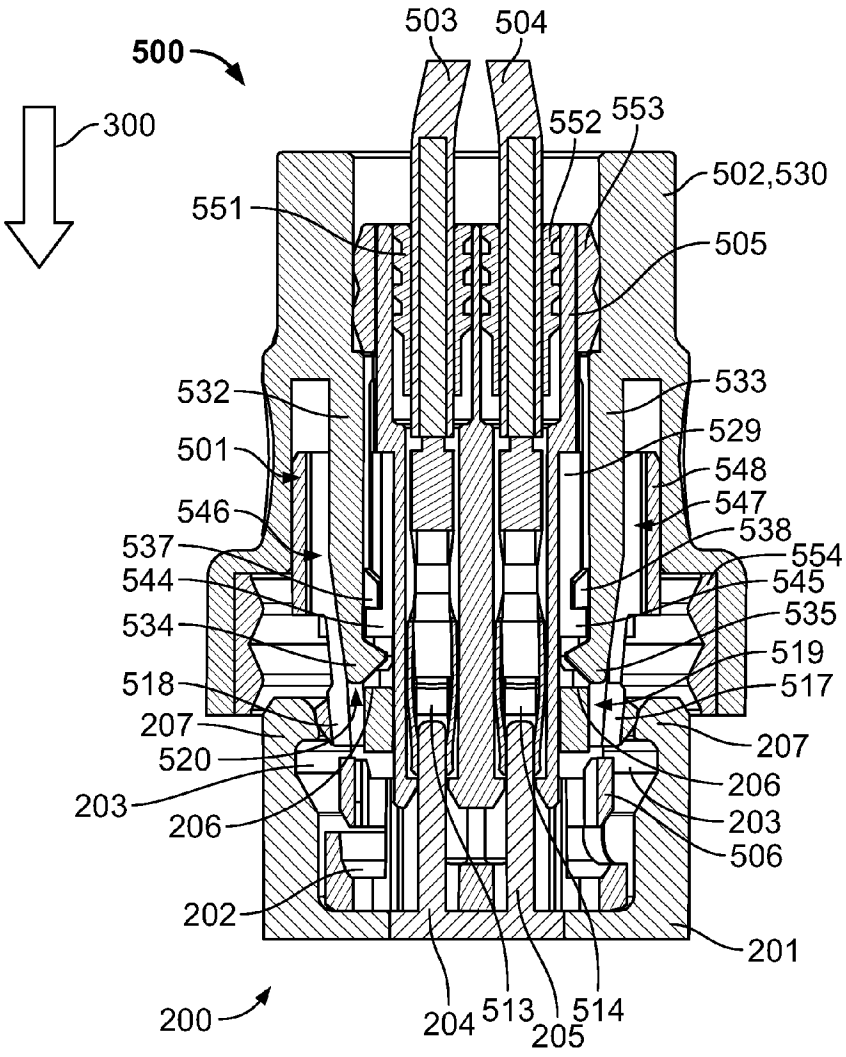
FIG. 8B is a sectional view of a second step of plugging the connector of FIG. 6 in the ignition support.
Figure 8A:
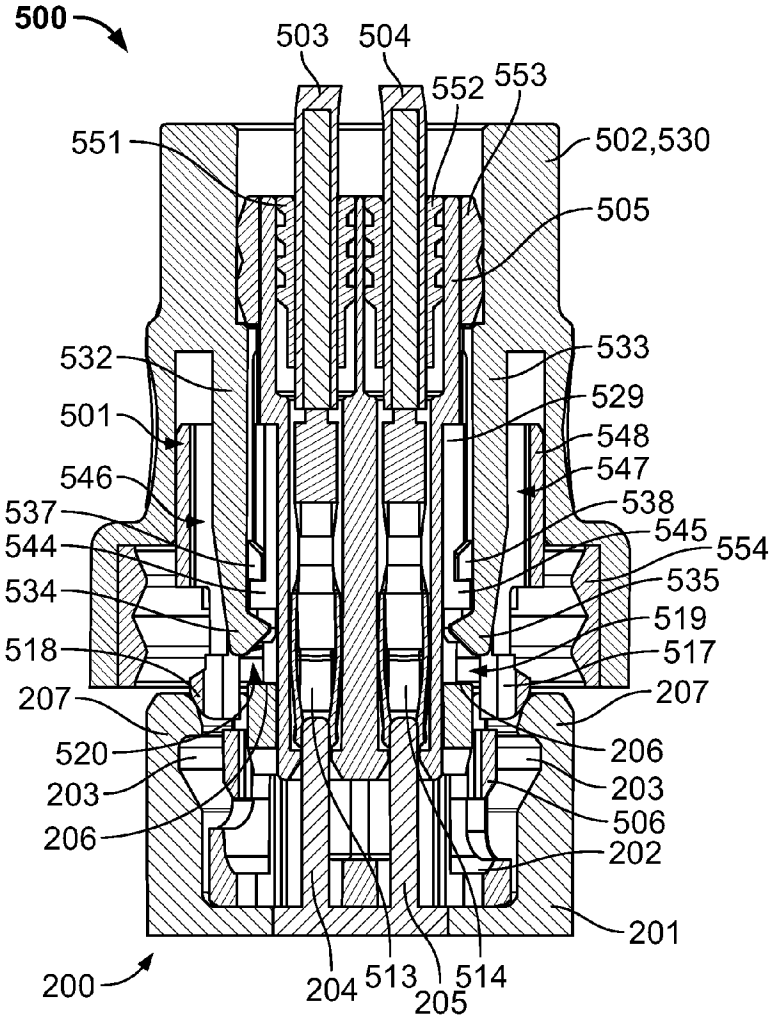
FIG. 8A is a sectional view of a first step of plugging the connector of FIG. 6 in an ignition support.

A first insertion step shown in FIG. 8A is analogous to a step between the first step shown in FIG. 3A and the second step shown in FIG. 3B. In the first step shown in FIG. 8A, the connector 500 is presented for insertion in the ignition support 200 in the insertion direction 300. Electrical contact is established between the pins 204, 205 and the posts 513, 514, and the housing locking arms 517, 518 just come into contact with the edge 207 of the base portion 201 of the ignition support 200, remaining in the delivery position. As in the preceding embodiments, the assembly comprising the cover/CPA device 502, 530, is blocked in the delivery position and cannot advance as far as a locking position.

A second step of the insertion of the connector 500 into the ignition support 200 is shown in FIG. 8B. This step is substantially similar to the one described with reference to FIG. 3B. The housing locking arms 517, 518 are resiliently deflected by pressing on the edge 207 of the ignition support 200 towards the inside of the connection portion 506 in the spaces 519, 520. The assembly comprising the cover/CPA device 502, 530 is still blocked in the delivery position. The latches 534, 535 of the CPA locking arms 532, 533 contact the section 206 of the retention ring 202 of the ignition support 200.

Figure 8D:
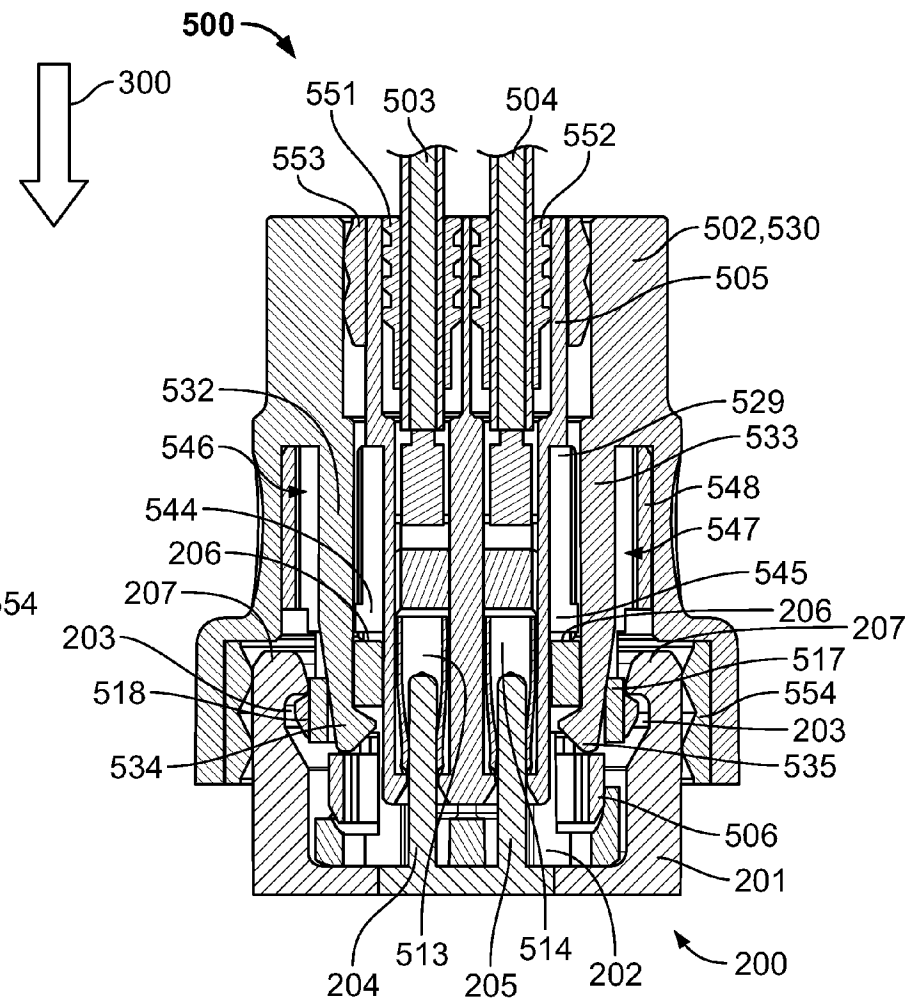
FIG. 8D is a sectional view of a fourth step of plugging the connector of FIG. 6 in the ignition support.
Figure 8C:
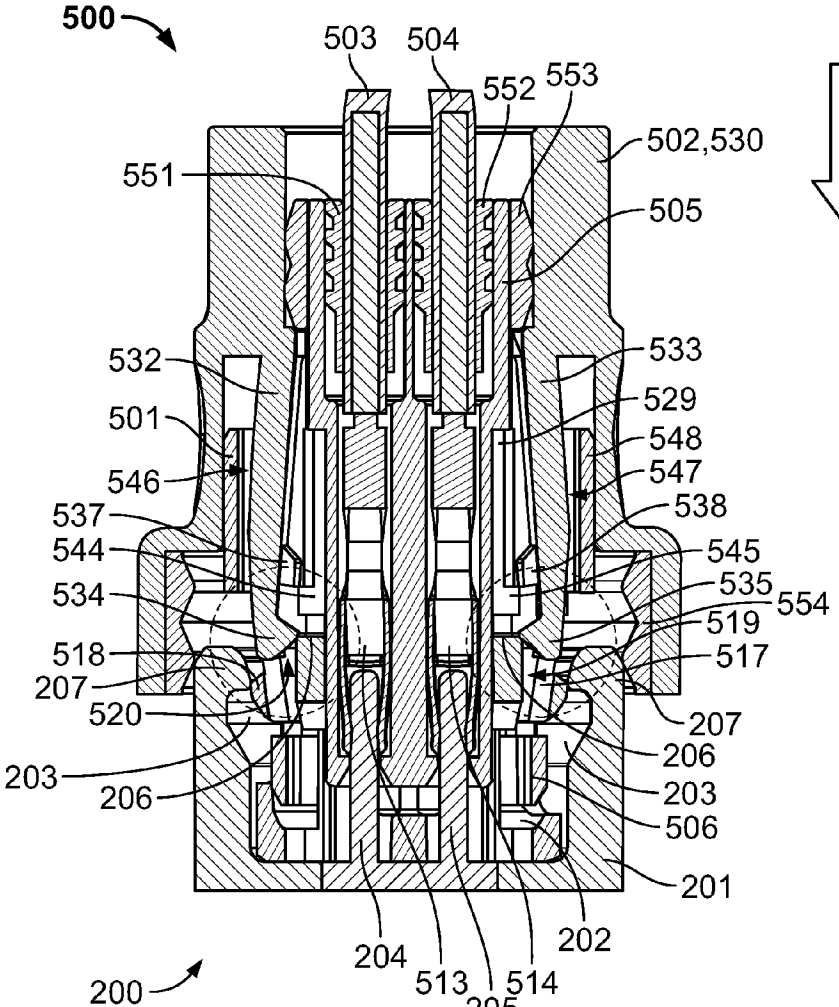
FIG. 8C is a sectional view of a third step of plugging the connector of FIG. 6 in the ignition support.

A third step of the insertion of the connector 500 into the ignition support 200 is shown in FIG. 8C. This step is substantially similar to the one described with reference to FIG. 3C. The resilient return of the housing locking arms 517, 518 to the delivery position thereof, having passed the edge 207 of the ignition support 200, now produces the main or primary locking of the connector 500 to the ignition support 200, as the housing locking arms 517, 518 are received in the locking groove 203. As shown by the two zones circled with broken lines in FIG. 8C, the latches 534, 535 of the CPA device 530 interact with the contact section 206, which resiliently deflects the CPA locking arms 532, 533 radially towards the outside of the connector 500 and into the spaces 546, 547. The protrusions 537, 538 are disengaged from abutment against the ribs 544, 545 by deflecting of the CPA locking arms 532, 533. The CPA device 530 is thus released from the delivery position.

As shown in FIG. 8D, in a fourth step, the CPA device 530 released from the delivery position is inserted into the housing 501 to a locking position of the CPA device 530, similarly to the step shown in FIG. 3D. The protrusions 537, 538 have passed the ribs 544, 545 and the CPA locking arms 532, 533 resiliently return to a rest position, forming a secondary locking of the connector 500 to the ignition support 200. The CPA locking arms 532, 533 are received behind the housing locking arms 517, 518, securing the housing locking arms 517, 518 in the locking groove 203 and thereby preventing the housing locking arms 517, 518 from opening and the connector 500 from disconnecting from the ignition support 200. The latches 534, 535 also hook to the retention ring 202 below the contact section 206.

The CPA locking arms 532, 533 secure the CPA device 530 in the delivery position and prevent the CPA device 530 from performing secondary locking before the connector 500 is correctly inserted in the ignition support 200. The CPA locking arms 532, 533, as described above, also release the CPA device 530 from the delivery position and perform the secondary locking when the connector 500 is correctly inserted in the ignition support 200. Furthermore, the fluid-tightness of the locked system in relation to the environment can be assured by the sealing joint 554 between the portion forming the cover 502 and the base portion 201 of the ignition support 200, by the sealing joint 553 between the portion forming the cover 500 and the housing 501, and by the sealing joints 551, 552 between the cables 503, 504 and the housing 501.

What is claimed is:

1. An electrical connector, comprising:

a housing configured for plugging in to a mating connector and having a housing locking arm locking the housing to the mating connector, the housing receiving a plurality of electrical terminals to be connected to a plurality of mating electrical terminals of the mating connector; and a connector position assurance device having a connector position assurance locking arm with a latch disposed on an end of the connector position assurance locking arm, the connector position assurance locking device insertable in the housing in an insertion direction to a delivery position and a locking position, the connector position assurance locking arm preventing unlocking of the housing locking arm from the mating connector in the locking position and the latch engaging the mating connector in the locking position when the housing is plugged in and locked to the mating connector, insertion of the connector position assurance device is blocked at the delivery position and prevented from reaching the locking position if the housing is not plugged in or locked to the mating connector.

2. The connector of claim 1, wherein abutment of the connector position assurance device with the mating connector unblocks the connector position assurance device and permits insertion to the locking position.

3. The connector of claim 1, wherein a rib is disposed on an internal portion of the housing.

4. The connector of claim 3, wherein the connector position assurance locking arm abuts the rib and blocks the connector position assurance device at the delivery position.

5. The connector of claim 4, wherein the connector position assurance locking arm has a protrusion abutting the rib during insertion of the connector position assurance device in the housing.

6. The connector of claim 4, wherein the rib projects radially outward on the internal portion of the housing.

7. The connector of claim 4, wherein the abutment of the connector position assurance locking arm on a contact section of the mating connector resiliently deflects the connector position assurance locking arm.

8. The connector of claim 7, wherein the resilient deflection of the connector position assurance locking arm permits the connector position assurance device to be unblocked and move from the delivery position to the locking position.

9. The connector of claim 7, wherein the latch abuts the contact section of the mating connector to resiliently deflect the connector position assurance locking arm.

10. The connector of claim 1, further comprising a cover attachable to the housing and at least partially enclosing the electrical terminals.

11. The connector of claim 10, wherein the cover is integrally formed with the connector position assurance device.

12. The connector of claim 10, wherein the cover has an opening forming a passage for insertion of the connector position assurance device into the housing.

13. The connector of claim 12, wherein the connector position assurance locking arm extends through the opening of the cover.

14. The connector of claim 10, further comprising a first sealing joint disposed between the cover and the mating connector.

15. The connector of claim 14, further comprising a second sealing joint disposed between the connector position assurance device and the cover.

* * * * *